United States Patent [19]

Shiraishi et al.

[11] Patent Number: 4,743,142

[45] Date of Patent: May 10, 1988

[54] PRECOATED CORROSION-RESISTANT STEEL PIPE PILES FOR MARINE USE, AND STRUCTURE THEREOF

[75] Inventors: Motoo Shiraishi, Tokyo; Mansei Tanaka, Chiba; Minoru Nakamura; Koichi Sato, both of Tokyo, all of Japan

[73] Assignee: Nippon Steel Corporation, Tokyo, Japan

[21] Appl. No.: 872,915

[22] Filed: Jun. 10, 1986

Related U.S. Application Data

[63] Continuation-in-part of Ser. No. 633,422, Jul. 19, 1984, abandoned.

[51] Int. Cl.[4] ..... E02D 5/60

[52] U.S. Cl. ..... 405/216; 405/211; 52/727

[58] Field of Search ..... 405/195, 211, 216, 217; 52/727, 728

[56] References Cited

U.S. PATENT DOCUMENTS

| | | | |
|---|---|---|---|
| 2,470,149 | 5/1949 | Derby | 405/216 |
| 2,791,096 | 5/1957 | Morton et al. | 405/216 |
| 2,874,548 | 2/1959 | Drushel et al. | 405/216 |
| 3,181,300 | 5/1965 | Plummer | 405/216 |
| 3,321,924 | 5/1967 | Liddell | 405/216 |
| 3,370,998 | 2/1968 | Wiswell | 405/216 X |
| 3,417,569 | 12/1968 | Laughlin | 405/216 |
| 3,448,585 | 6/1969 | Vogelsang | 405/216 |
| 3,505,758 | 4/1970 | Willisford | 405/216 X |
| 4,283,161 | 8/1981 | Evans et al. | 405/216 |
| 4,340,622 | 7/1982 | Kik et al. | 405/216 X |
| 4,415,293 | 11/1983 | Engel et al. | 405/216 |

FOREIGN PATENT DOCUMENTS

| | | | |
|---|---|---|---|
| 465358 | 5/1950 | Canada | 405/216 |
| 7511739 | 4/1976 | Netherlands | 405/216 |
| 1494072 | 12/1977 | United Kingdom | 405/216 |

*Primary Examiner*—Randolph A. Reese
*Assistant Examiner*—John Ricci
*Attorney, Agent, or Firm*—Wenderoth, Lind & Ponack

[57] ABSTRACT

Precoated corrosion-resistant steel pipe piles, and structures thereof, for driving into the sea bed wherein the waterproofness, corrosion resistance, and scratch resistance of the steel pipe piles are considerably improved by applying a polyethylene resin over the length thereof.

2 Claims, 5 Drawing Sheets

PRECOATED CORROSION-RESISTANT STEEL PIPE PILES FOR MARINE USE, AND STRUCTURE THEREOF

CROSS REFERENCE TO THE RELATED APPLICATION

The present invention is a continuation-in-part application of application Ser. No. 633,422, filed July 19, 1984, now abandoned.

BACKGROUND OF THE INVENTION

The present invention relates to precoated corrosion-resistant steel pipe piles for marine use which support structures in ports and harbors, seawater and rivers.

1. Description of the Prior Art

Steel pipe piles have been heretofore employed as foundation piles of buildings on land and in harbors, river embankments and piers, and further, with regard to marine structures, have widely been used as steel building materials able to cope with deep water and poor ground.

In general, steel pipe piles for use in harbors, seawater, and rivers have been heretofore used without any covering. In recent years, however, harbor, seawater and river structures are required to possess an extended durability of 40 to 50 years.

It has thus become necessary to take anticorrosion measures enabling steel pipe piles used in such harshly corrosive environments to maintain their corrosion-resistance for such extended periods of time.

Various methods for preventing the corrosion of steel pipe piles have been known, such as use of a coating of tar-epoxy, electrical protection, and a mortar coating method employing fiber reinforced plastic (hereinafter referred to as the FRP cover method).

However, the tar-epoxy coating method is troublesome because it has to be reapplied within a few years. Furthermore, extended corrosion resistance cannot be expected, as even if the steel pipe pile is coated with the tar-epoxy before it is driven into place, the coating is soft and tends to be scored when being handled or driven. In addition, after having been driven into place, it may be struck by driftwood or the like, causing damage to the coating and making the pile more susceptible to corrosion at that point. Moreover, if the steel pipe pile is coated with the tar-epoxy after it is driven into place, it follows that only the part above the water will be protected from corrosion. If the underwater portion of steel pipe pile is to be coated, the cost therefor would become very high because of the necessity of having to drain the water from around the pile.

On the other hand, however, the electrical corrosion protection measure is disadvantageous in that the electrochemical function is such that corrosion protection is difficult in the splash zone and the tidal zone, where steel corrosion develops most rapidly.

Corrosion of steel materials in harbors, seawater and rivers proceeds most rapidly in the splash zone and the tidal zone, and is slower underwater, and slower still in sea mud.

"Splash zone" in this specification refers to the portion above the mean high water mark obtained from the high point of the highest tide; "tidal zone" refers to the zone between the mean high water mark and the mean low water mark; and "seawater zone" refers to the portion below the mean low water mark.

According to a recent study on the corrosion rate of steel structures in harbors conducted by an official organization, the average corrosion rate of steel pipe pile is 0.37 mm/year to 0.6 mm/year in the splash zone, and 0.35 mm/year to 0.5 mm/year in the tidal zone and thereabout. It was found that the means corrosion rate in the seawater zone tends to gradually decrease as the depth of the seawater increases, and it is less than 0.05 mm/year.

It was also reported that the corrosion rate was 0.1 mm/year to 0.5 mm/year in a riprap layer, 0.05 mm/year in sea sludge, and 0.01 mm/year to 0 mm/year in sea mud.

Assuming a mean corrosion ratio of 1.0 in the splash zone and the tidal zone, the corrosion ratio in the seawater zone amounts only to about 1/10, and to only about 1/50 in the sea mud.

It follows from the above that electrical corrosion protection is hardly effective for the steel pipe pile in the splash zone and the tidal zone where protection against corrosion is most desired. Consequently, as a most effective means for preventing corrosion in the splash and tidal zones, where corrosion is most marked, the following method has recently been proposed.

FIG. 1 of the accompanying drawings shows an embodiment of a conventional method of preventing corrosion.

In FIG. 1, in a steel pipe pile 1 driven into the sea bed 3, a FRP tubular cover 9 encloses the splash zone 4, the tidal zone 5, and the part of the outer surface of the pile just below the tidal zone 5, with the space between the tubular cover 9 and the steel pipe pile 1 being filled with mortar 10. The lower end of the mortar 10 is covered by an anticorrosion seal means 11. In FIG. 1, 7 is a concrete structure and 8 is a riprap layer.

FIG. 2 is an enlarged view of the principal portion of FIG. 1. To carry out the work of FIG. 1, a specialist, such as a diver, is required, and since the work is affected considerably by waves, tides, and other such marine conditions, the method is disadvantageous in that the resultant working efficiency is so poor that there is insufficient waterproofness along the boundary between the concrete structure built onto the top of the steel pipe pile and the mortar filling. Moreover, the cost is high.

SUMMARY OF THE INVENTION

It is an object of the present invention to provide a precoated corrosion-resistant steel pipe pile for marine use which has outstanding resistance to corrosion and scoring.

It is another object of the invention to provide a marine structure in which the precoated corrosion-resistant steel pipe pile is employed.

Other and further objects of the invention will become apparent from the following description made with reference to the accompanying drawings.

DETAILED DESCRIPTION OF THE INVENTION

The present invention relates to a precoated corrosion-resistant steel pipe pile and a structure employing the steel pipe piles, wherein the steel pipe pile to be driven into the sea bed is previously coated with a polyethylene resin material (hereinafter referred to as "coating material") to provide corrosion-resistance at least in the tidal zone and splash zone.

Figure 1:
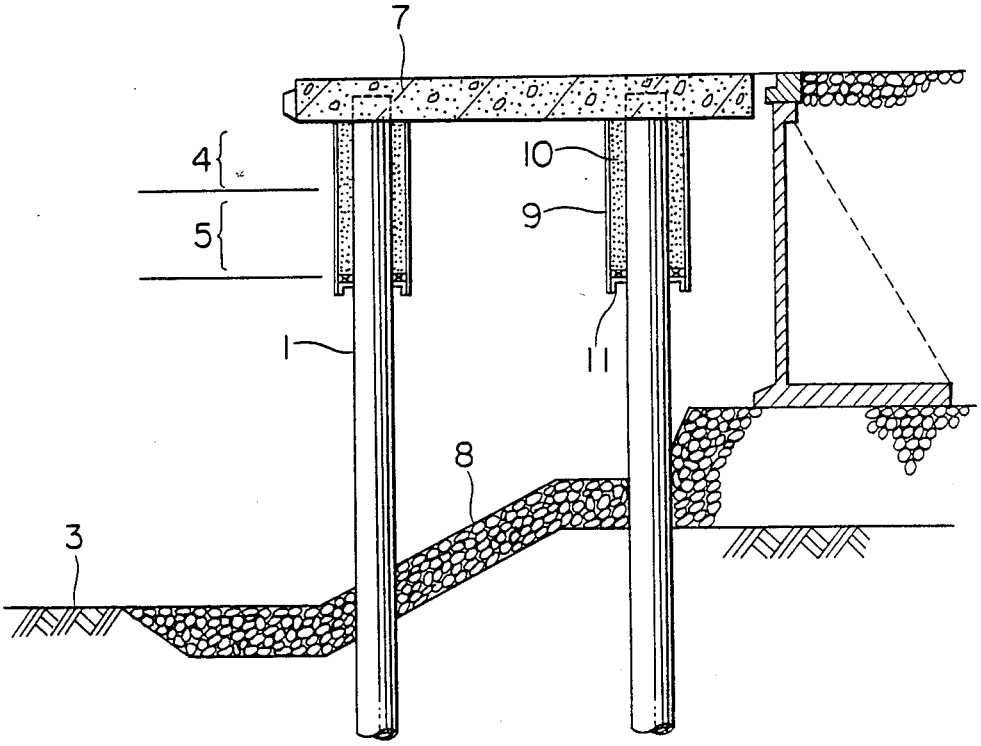
FIG. 1 (PRIOR ART)
FIG. 1 is a side view of a conventional method for the prevention of corrosion of steel pipe piles.
Figure 2:
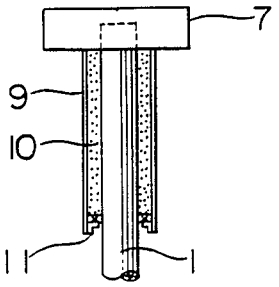
FIG. 2 (PRIOR ART)
FIG. 2 is an enlarged view of the principal parts of FIG. 1.
Figure 3:
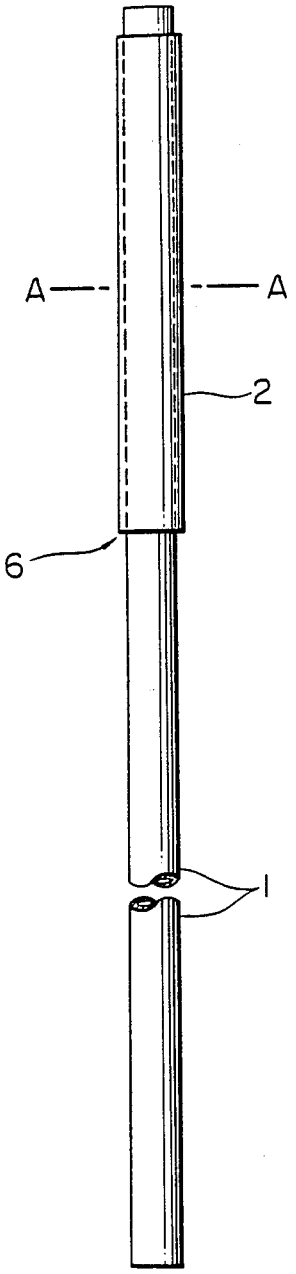
FIG. 3 is a side view of a steel pipe pile according to this invention.
Figure 4:
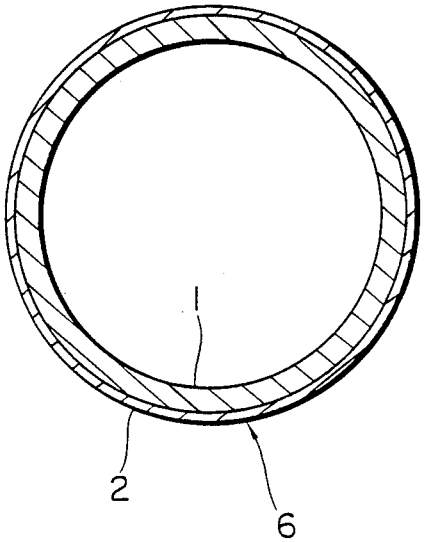
FIG. 4 is an enlarged cross-sectional view through the line A—A of FIG. 3.

A first embodiment of the present invention will be described in detail with reference to FIGS. 3-5.

The splash zone 4, tidal zone 5, and a portion of the surface extending slightly below these of a steel pipe pile to be driven into the sea bed 3 are all covered with the coating material 2. The lower end of the precoated corrosion-resistant steel pipe pile 6 thus constructed is driven into the sea bed 3. A concrete structure 7 consisting of concrete slabs, such as a pier or jetty, is then constructed on the top of the precoated corrosion-resistant steel pipe piles 6. That is, after the concrete structure has been built up, the upper part of the coating material 2 of the precoated corrosion-resistant steel pipe piles is located inside the concrete structure 7.

Figure 5:
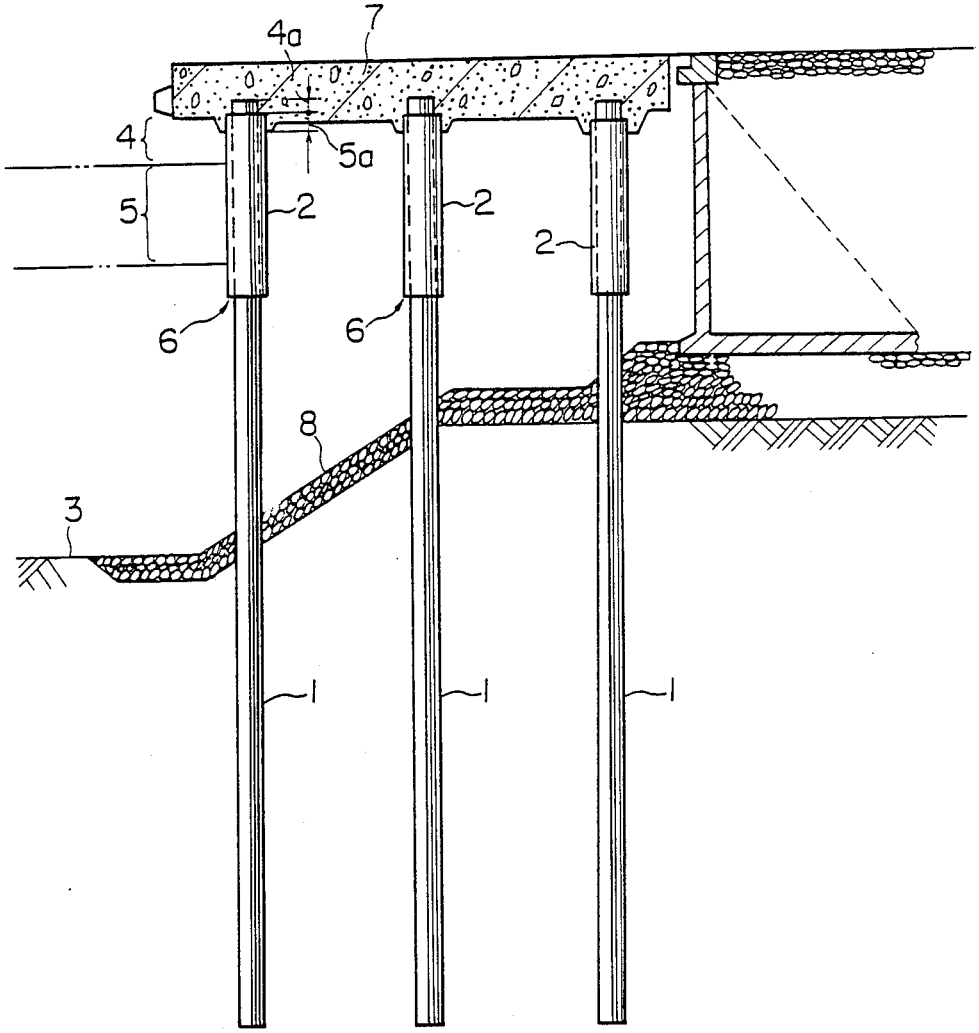
FIG. 5 is a longitudinal sectional view of part of an embodiment of the present invention wherein the steel pipe pile of the present invention is used to support a concrete structure.

In FIG. 5, the part 4*a* of the head of the pile that is bare of coating and the coated part 5*a* are entirely inserted into the concrete slab 7. Accordingly, the coated part 5*a* has excellent corrosion resistance while the bare part 4*a* is provided with excellent shear resistance by the bonding thereof to the concrete slab.

Thus, unlike the conventional methods of preventing corrosion of steel pipe piles, the precoated corrosion-resistant steel pipe pile of the present invention is coated in the factory with the coating material 2 to the extent required by the design. Thus, the steel pipe pile can be proofed against corrosion surely and easily. In particular, the portion where the steel pipe pile meets the concrete structure can be protected from the corrosive effect of seawater splashing by the coating of the head of the steel pipe pile and the insertion thereof into the concrete structure.

Figure 6:
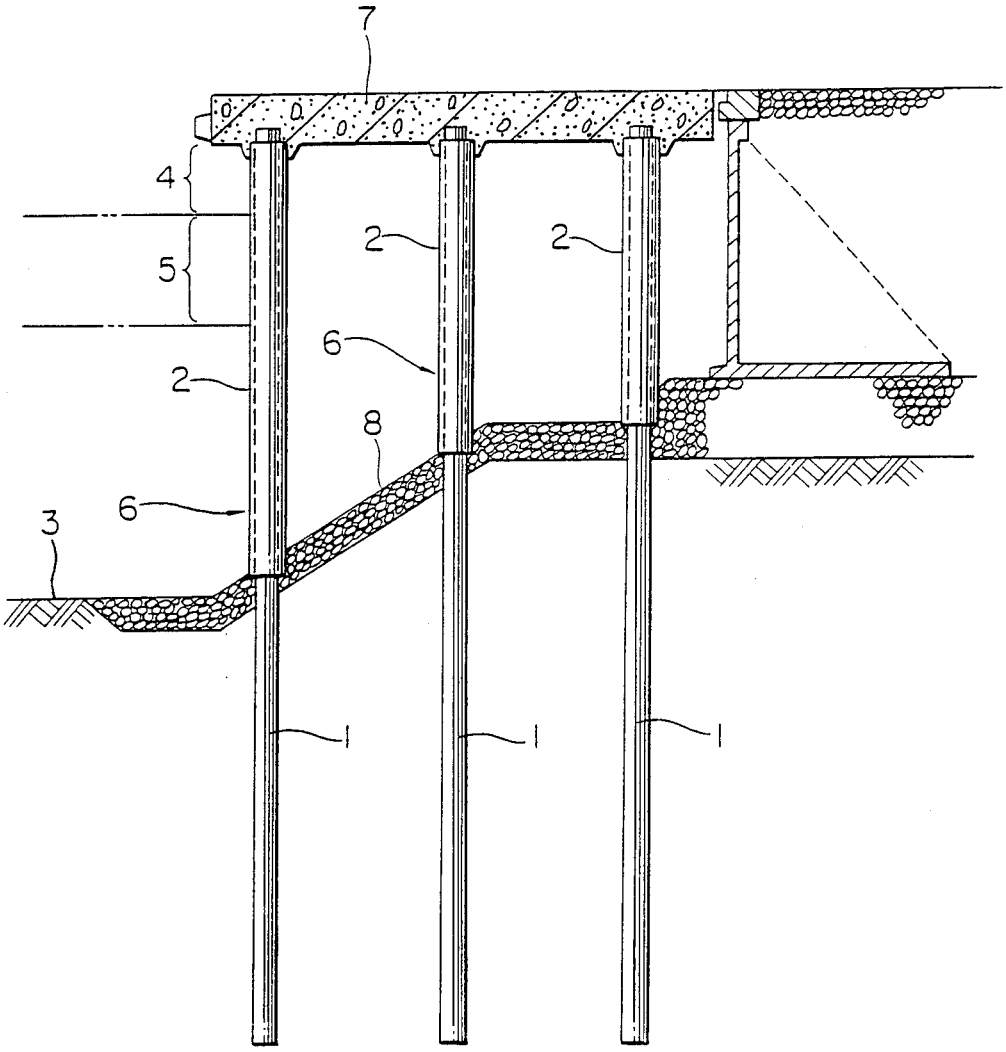
FIG. 6 is a longitudinal sectional view of part of another embodiment using the steel pipe pile of the present invention.

FIG. 6 shows a second embodiment of the invention. The coating material 2 is previously applied over the length of the steel pipe pile 1 from where it is located in the concrete structure 7, down through the splash zone 4 and the tidal zone 5, to the riprap layer 8 on the sea bed. The other parts of the construction are the same as those of the first embodiment.

In accordance with the present invention, the thickness of the coating material 2 is preferably from 1.5 to 4.5 mm, and more preferably, 2 to 3 mm.

In the second embodiment of the invention, wherein the coating material 2 is applied along the whole length of the steel pipe pile 1, from where it is located in the concrete structure 7, and down to just below the surface of riprap layer 8 or the sea bed 3, the pile can be permanently proofed against corrosion from the concrete structure 7 right down to just below the surface of the riprap layer 8 or sea bed 3. In addition, the coating material 2 has excellent resistance to acids and other chemicals, hence the steel pipe pile is protected from corrosion even if industrial wastes containing acidic substances and other chemicals are disposed of around in the vicinity of the pile.

That is, the steel pipe pile according to this invention can withstand the corrosive action of acidic soils of up to pH 5, and also has high resistance to soils containing anaeorbic bacteria, such as sulphate reducing bacilli.

The durability of the coating material 2 to weather, corrosion or scoring can be further improved by the addition of carbon black, which intercepts ultraviolet rays, and an anti-oxidant consisting of phenolic or sulphur compound.

Examples of the composition of the coating material 2 are shown as follows.

EXAMPLE 1

| | |
|---|---|
| Polyethylene resin | 97.2 wt % |
| Carbon black | 2.6 wt % |
| Phenolic anti-oxidant | 0.2 wt % |

EXAMPLE 2

| | |
|---|---|
| Polyethylene resin | 96.9 wt % |
| Carbon black | 2.8 wt % |
| Phenolic anti-oxidant | 0.3 wt % |

The polyethylene resin has a density of 0.915–0.970 g/cm$^3$ and a melt index of 0.05–0.5 g/10 min. And use of polyethylene copolymer comprising vinyl acetate, or butene and hexene, is preferable. A polyethylene copolymer resin having a density of 0.915–0.940 g/cm$^3$ and a melt index of 0.05–0.15 g/10 min. is the most preferred.

Figure 7:
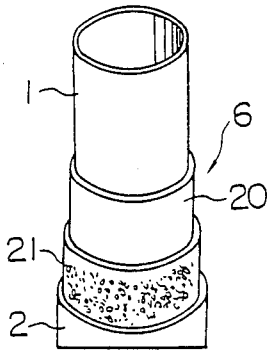
FIG. 7 is a perspective view of part of a steel pipe pile 6 according to the present invention.

The corrosion-resistant steel pipe pile of the present invention, as shown in FIG. 7 comprises two primer layers 20, an adhesive agent layer 21 and the polyethylene resin layer 2. The bare part 4*a* is covered with an adhesive agent layer 21.

It is desirable that scoring or scratching of the polyethylene covering layer should not lead to cracking at the scored portion generated by internal stress. In order to attain this object, it is preferably to provide a low density polyethylene having a low internal stress and a high molecular volume.

The polyethylene used in the steel pipe piles of the present invention has good resistance to stress cracking because it has a low density, a low internal stress (about one-half that of high-density polyethylene), and a high molecular volume, which indicates a high resiliency of the polyethylene resin (0.12 to 0.13 g/10 mins.).

Table 1 shows the results of six tests of the polyethylene resin of this invention compared with that of the prior art.

Figure 8:
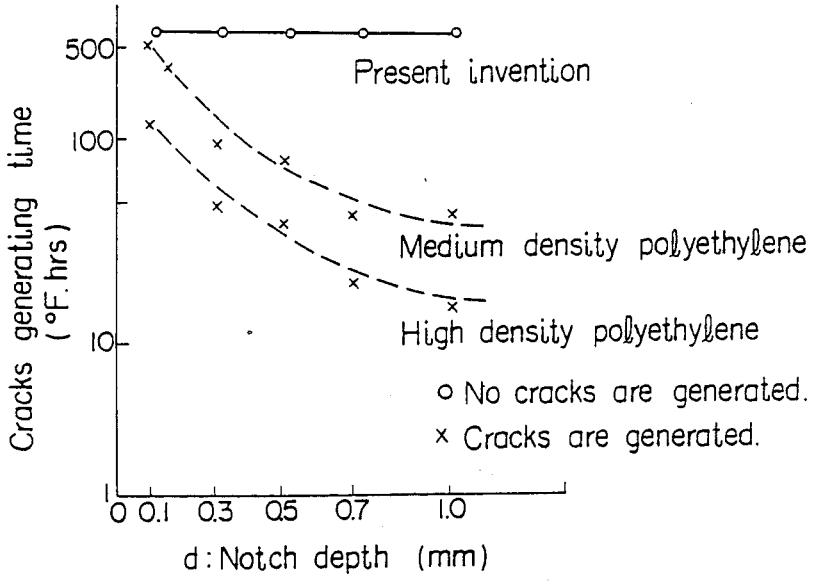
FIG. 8 is a graph showing the relationshiop between the environmental stress cracks resistance generated over time and notch depth.

FIG. 8 is a graph showing the relationship between the cracks generated with time and notch depth.

TABLE 1

| Test Item | Testing Method | Polyethylene resin of the present invention (high pressure manufacturing process) | High density polyethylene (low & middle pressure manufacturing process, prior art) |
|---|---|---|---|
| Thermal deterioration | 100° C. × 100 hrs | Rate of residual elongation 95% or over | Rate of residual elongation 40 to 80% |
| Absorption time of oxygen gas | measurement at 200° C. after immersion in seawater at 100° C. (100 days) | More than one hour | 20 minutes |
| Exudation of anti-oxidant deterioration preventive agent | 70° C. × 1000 hrs | Rate of reduction of anti-oxidant deterioration preventive agent 7% or less | Rate of reduction of anti-oxidation deterioration preventive agent 20 to 55% |
| Penetration resistance | DIN 30670<br>1.8 mm dia.<br>100 Kg<br>24 hrs at 60° C. | 0.2 to 0.3 mm | 0.1 to 0.2 mm |
| Stress cracking | ASTM D 1693 F (50)<br>Kneaded by a plastic bending unit (154° C., 1 hr, 125 rpm) and then a test piece is made. | 500 hrs or more No cracks | Cracks generated in 100 hrs. |
| Low temperature brittleness | ASTM D746 (artificial scratch depth of 0.2 mm is added.) | −30° C. or less | −15° C. |

Namely, the marine structure of the present invention comprises a steel pipe piling and a flat concrete slab, the pipe piling being coated over the whole length thereof.

The coating material comprises two kinds of primer material, an adhesive material and a polyethylene resin. The polyethylene resin is a polyethylene copolymer selected from the group consisting of vinyl acetate, butene and hexene. A copolymer consisting of vinyl acetate and polyethylene has considerably more endurance than common polyethylene. This is one feature of the present invention.

Another feature is the thickness of the coating, 1.5–4.5 mm.

Corrosion resistance, resistance to scoring or scratching and waterproofness are achieved by the above novel construction elements of the present invention.

The corrosion-resistant steel pipe pile of this invention is produced as follows. The coating material of this invention is continuously extruded in a semimolten strip using an extruding machine. The steel surface of the pile is prepared by blasting, and the pipe is then preheated and coated with two layers of primer, and then coated with an adhesive agent. The coating material is wrapped around the steel pipe so that each turn partially overlaps the preceding one. Immediately after application of the coating material, the steel pile is subjected to finish pressure forming by a finish pressure forming roll in order to attain a uniform thickness of the coating material over the required portion.

Thus, the corrosion-resistant steel pipe pile of the present invention comprises two layers of primer, an adhesive layer, and a polyethylene resin layer.

In accordance with the present invention, the steel pipe pile 1 can be effectively protected from corrosion over at least the tidal zone and the splash zone for an extended period of time by the use of the coating material 2 with its waterproofness and resistance to corrosion and scoring or scratching. Moreover, since the steel pipe pile 1 has been already coated with the coating material 2 before it is driven into place at the site, quality maintenance can be fully satisfied. Further, as the coating material 2 is strong, it is not easily damaged during handling or by the impact of floating driftwood and the like.

The steel pipe pile of this invention can be driven using conventional pile-driving methods, hence no underwater work for providing anti-corrosion is required after the pile has been driven. In addition, there are economical advantages such as that the coating material 2 is highly durable and thus requires no maintenance.

What is claimed is:

1. A marine structure comprising a corrosion resistant steel pipe piling consisting of, in sequence, a top head portion, a splash zone portion, a tidal zone portion and a bottom portion extending into a riprap layer on the sea bed, and a concrete slab supported by said piling, said piling being provided with a coating material comprising in sequence, a primer layer, an adhesive layer and a polyethylene resin layer, said coating material being applied over said top head portion, a splash zone portion, a tidal zone portion and bottom portion to at least the point where said bottom portion enters said riprap layer, and wherein said polyethylene resin layer comprises a polyethylene resin, carbon black, and a phenolic antioxidant, said polyethylene resin being a copolymer consisting of polyethylene and a member selected from the group of vinyl acetate, butene, and hexene, said copolymer having a density of 0.915–0.970 g/cm$^3$ and a melt index of 0.05–0.5 g/10 minutes.

2. The marine structure according to claim 1 wherein the copolymer consists of polyethylene and vinyl acetate.

* * * * *